US011235220B2

(12) United States Patent
Washburn

(10) Patent No.: US 11,235,220 B2
(45) Date of Patent: Feb. 1, 2022

(54) ADVANCED AND VERSATILE TENNIS BACKBOARD UTILIZING FLEX TECHNOLOGY

(71) Applicant: Merrill Washburn, Provo, UT (US)

(72) Inventor: Merrill Washburn, Provo, UT (US)

( * ) Notice: Subject to any disclaimer, the term of this patent is extended or adjusted under 35 U.S.C. 154(b) by 125 days.

(21) Appl. No.: 16/518,289

(22) Filed: Jul. 22, 2019

(65) Prior Publication Data

US 2021/0023430 A1 Jan. 28, 2021

(51) Int. Cl.
*A63B 69/38* (2006.01)
*A63B 69/00* (2006.01)
*A63B 102/02* (2015.01)

(52) U.S. Cl.
CPC ..... *A63B 69/0097* (2013.01); *A63B 69/38* (2013.01); *A63B 2102/02* (2015.10); *A63B 2209/00* (2013.01)

(58) Field of Classification Search
CPC .. A63B 69/0097; A63B 69/38; A63B 2102/02
USPC ..... 473/434, 435
See application file for complete search history.

(56) References Cited

U.S. PATENT DOCUMENTS 3,563,544 A * 2/1971 Hedrick ..... A63B 63/00 473/435
3,692,307 A * 9/1972 Henry ..... A63B 69/0097 473/435
4,065,126 A * 12/1977 Mantz ..... A63B 37/12 473/462
D265,413 S * 7/1982 Millikan ..... D21/799.1
4,373,720 A * 2/1983 Lombardi ..... A63B 69/0097 273/DIG. 8
4,588,190 A * 5/1986 Stewart ..... A63B 69/0097 273/395
5,407,211 A * 4/1995 Bottiglieri ..... A63B 63/00 273/400
6,422,956 B1 * 7/2002 Kusmiss ..... A63B 24/0003 473/435
6,991,566 B1 * 1/2006 McKinney, Sr. .. A63B 69/0097 473/459
2006/0281589 A1 * 12/2006 McTavish ..... A63B 69/0097 473/459
2015/0190701 A1 * 7/2015 Annapragada ..... A63B 69/0097 473/435
2018/0369674 A1 * 12/2018 Schaefer ..... A63B 69/0097

* cited by examiner

*Primary Examiner* — Joshua T Kennedy

(57) ABSTRACT

The nature of the invention enables the same tennis backboard to be used in any of the three standard backboard positions; vertical, sloped, or curved. Furthermore, the design allows for the angle of slope, and the curvature of the board, to be made at the location where the board is mounted. The material used is a paper/resin composite product that is durable, dense, flexible, and not affected by adverse weather conditions. The invention incorporates flex technology allowing the board to flex upon impact from a tennis ball. The same framework can be used to mount the backboard to an existing chain-link fence, concrete wall, brick wall, stud wall, portable platform, or other sturdy structure.

1 Claim, 11 Drawing Sheets

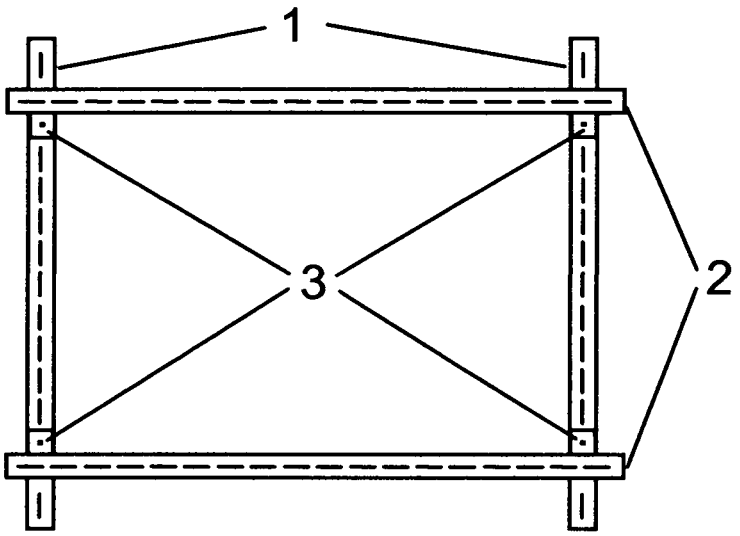
FIG. 2A
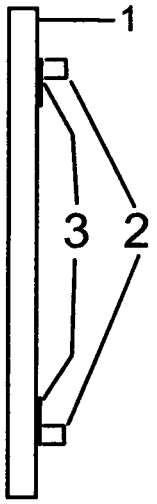
FIG. 2B
FIG. 2C
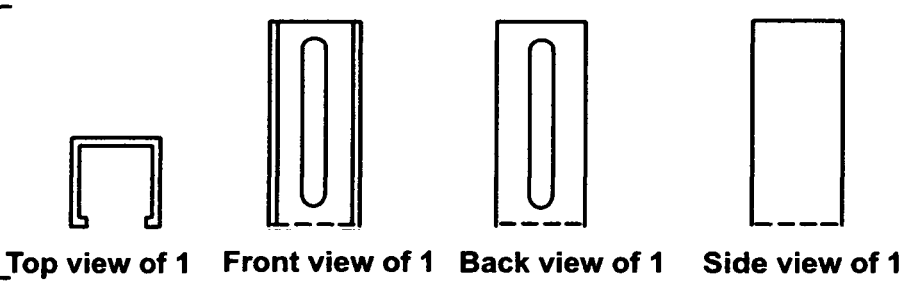
FIG. 2D
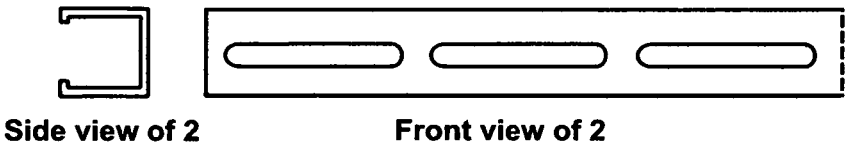
FIG. 2E
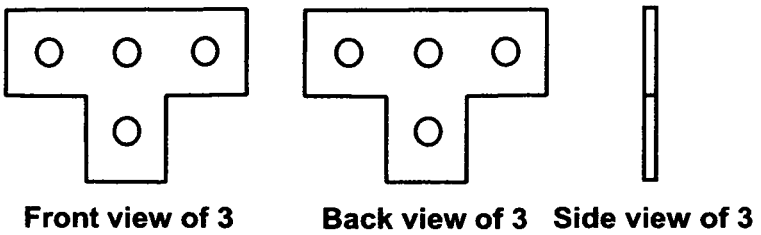

ADVANCED AND VERSATILE TENNIS BACKBOARD UTILIZING FLEX TECHNOLOGY

BACKGROUND OF THE INVENTION

Field of the Invention

However, this invention relates specifically to racket sports, such as tennis.

Description of the Related Art

A number of sports use a backboard for training purposes. However, this invention relates specifically to the sport of tennis. By using a backboard to hit a tennis ball against, a player can improve his skills relating to footwork and proper stroke technique. Backboards are available in a number of sizes, usually in a rectangular shape. They come in a variety of materials such as; plywood, fiberglass, polyethylene, etc. These materials have limitations and inherent problems. They are subject to rotting, warping, deterioration from the weather, and require constant maintenance. Many are large, heavy, cumbersome, expensive, and difficult to install. The boards are normally attached to existing fencing or other support structures. They are available in straight, sloped, or curved configurations.

SUMMARY OF THE INVENTION

Backboards to practice hitting against have been around for a long time. This invention has several objectives. The first objective is to provide a backboard made from materials that are strong, durable, lightweight, and not affected by rain, snow, cold, heat, or inclement weather conditions. Another objective is to provide a backboard, consisting of a frame and a single panel, ranging in size from 4 feet by 5 feet, up to 5 feet by 10 feet. The frame can also be easily attached to an existing chain-link fence, concrete wall, brick wall, stud wall, portable platform, or other rigid structure. Another objective is to use a single panel for the backboard rather than a plurality of panels, providing a seamless backboard for a consistent hitting surface and avoiding buckling, cracks, or inconsistencies in the hitting area. Another objective is to position the bottom of the backboard, when mounted on the frame, at a height of 36 inches, the standard height of the top of a tennis net. This discourages a player from developing poor hitting strokes, and helps the player focus on hitting a specific target rather than just attempting to keep the ball in play.

BRIEF DESCRIPTION OF THE DRAWINGS

FIG. 2A This drawing is a front view of the basic frame comprised of two vertical strut channels and two horizontal strut channels.

FIG. 2B This drawing is a side view of the backboard frame.

FIG. 2C This drawing shows various views of the vertical strut members.

FIG. 2D This drawing shows various views of the horizontal strut members.

FIG. 2E This drawing illustrates the Tee channel fitting.

LIST OF NUMBERED ITEMS USED IN DRAWINGS

1 Vertical member of frame comprised of slotted pre-galvanized metal strut channel.
2 Horizontal member of frame comprised of slotted pre-galvanized metal strut channel.
3 Tee flat plate fitting.
4 Backboard panel comprised of a single sheet of cellulose/phenolic resin material.
5 Portable cart used to support the backboard.
6 Bolt and channel nut used to fasten the Tee plate to the vertical channel strut member.
7 Bolt, washers, and nut used to fasten the backboard to the horizontal frame members.
8 Bolt and channel nut used to fasten the horizontal frame member to the Tee plate.
9 Angular fitting used to adjust the degree of slope of the backboard.
10 "Z" fitting used to adjust the degree of slope of the backboard.
11 Bolt and channel nut used to fasten the angular fitting to the vertical frame member.

12 Bolt, washers, and nut used to fasten the Tee plate to the angular fitting.

13 Bolt, washers, and nut used to fasten the "Z" fitting to the angular fitting.

14 Bolt, washers, and nut used to adjust the length of the "Z" fitting.

15 Bolt and channel nut used to fasten the horizontal frame member to the "Z" fitting.

16 Bolt and channel nut used to fasten the horizontal frame member to the angular fitting.

17 Bolt, washer, and channel nut used to change the curvature of the backboard.

DETAILED DESCRIPTION OF THE INVENTION

Figure 1A:
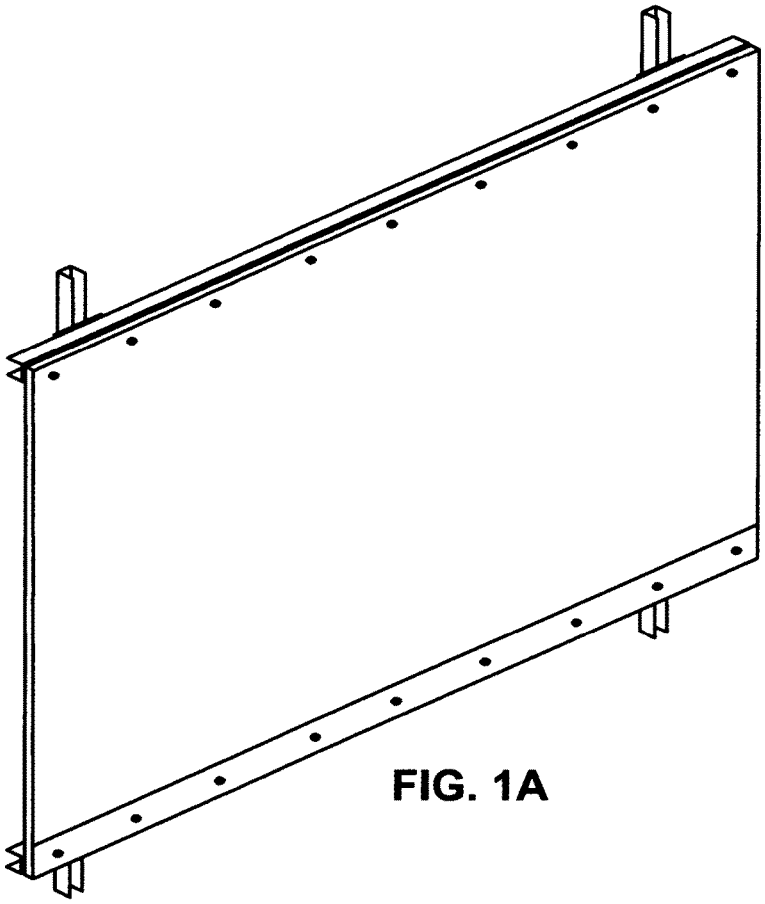
FIG. 1A This is a 3-dimensional drawing that illustrates the backboard installed in a vertical position.
Figure 1B:
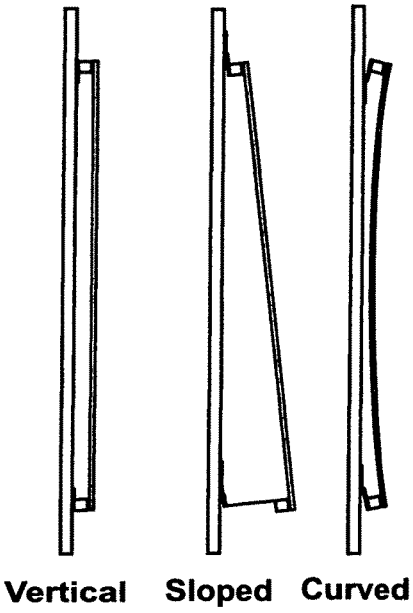
FIG. 1B This drawing shows the single panel of the backboard attached to the frame of said backboard in a vertical, sloped, or curved position.

FIG. 1A shows a backboard installed in a vertical position. FIG. 1B shows said backboard in a vertical, sloped, or curved setting. The backboard is attached to the two horizontal frame members with a plurality of bolts, washers, and nuts. The two horizontal frame members are fastened to the two vertical frame members using a Tee plate and channel nuts. The frame members are lengths of strut channel with pre punched slots. The vertical strut members can be installed on a variety of structures, such as: an existing chain-link fence; a concrete wall; a brick wall; a stud wall; or a portable platform. The vertical frame members are spaced apart at a desired distance depending on the structure they are attached to and the size of the backboard being used. Examples for the size of the backboard would be dimensions, such as: 4 foot by 5 foot; 4 foot by 6 foot; 4 foot by 8 foot; 4 foot by 10 foot; 5 foot by 8 foot; 5 foot by 10 foot; or any other suitable rectangular shape. Once the vertical frame members are installed, the two horizontal frame members are secured to the vertical frame members using Tee plates. Two Tee plate fittings are fastened to each of the vertical strut channels with bolts and strut nuts. The Tee plates can be moved up or down the strut channel for the desired spacing between the horizontal frame members. For a 4 foot by 6 foot tennis backboard, they would preferably be spaced at a distance of four feet, with the lower plate being secured at a height of 36 inches up from the ground level, which is the height of a tennis net at the center point. Once the four Tee plates have been secured to the vertical frame members, the horizontal frame members can be installed.

The material used for the backboard is a specially formulated paper/resin composite product that is strong, durable, and flexible, yet lightweight when compared to other materials being used for backboards. It is highly sustainable and not affected by adverse weather conditions. A single sheet is used for the backboard, eliminating any seams and providing a uniform hitting surface.

The material for the frame is pre-galvanized strut channel with pre-punched slots, eliminating the need for any additional cutting or drilling to assemble the framework and backboard. The backboard frame is shown in FIGS. 2A and 2B. The strut channel is available in a galvanized, painted, powder coated, epoxy, or other finishes suitable for an outdoor environment. FIGS. 2C, 2D, and 2E show details for the strut channel and Tee plate fitting.

Figure 3A:
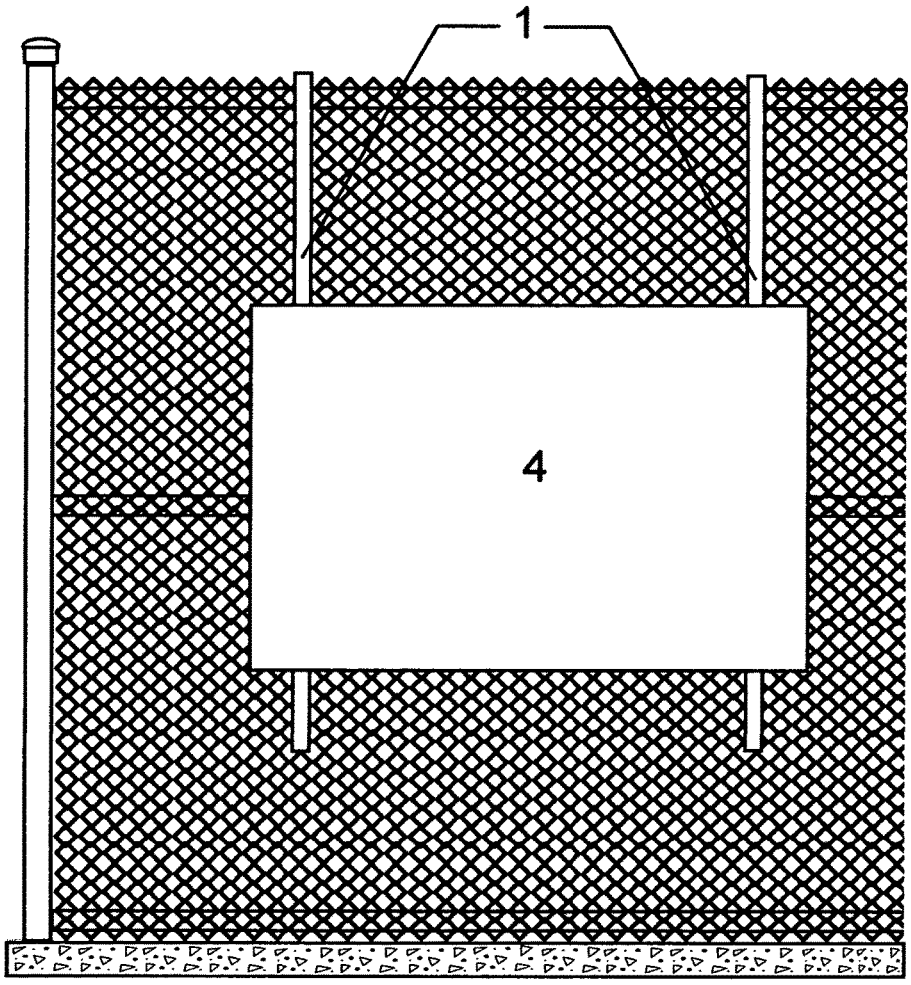
FIG. 3A This drawing shows the backboard installed on a chain-link fence.
Figure 3B:
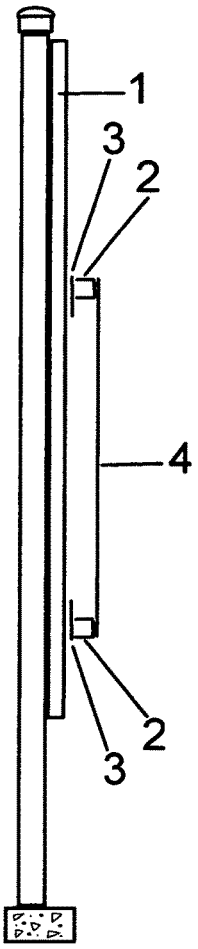
FIG. 3B This drawing is a side view of the backboard installed on a chain-link fence.
Figure 8A:
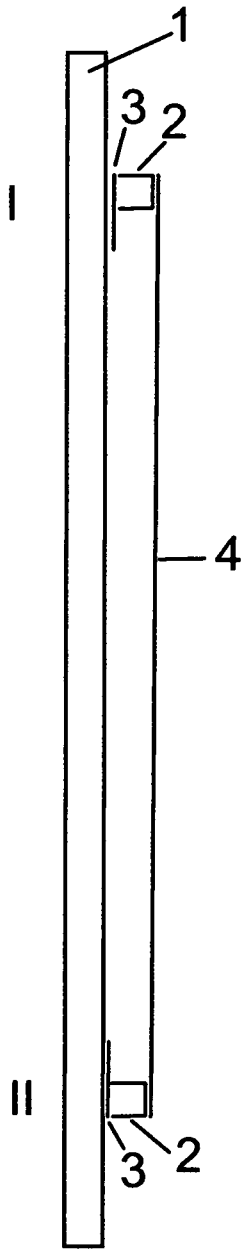
FIG. 8A This drawing is a side view of the backboard installed in a vertical position.
Figure 9A:
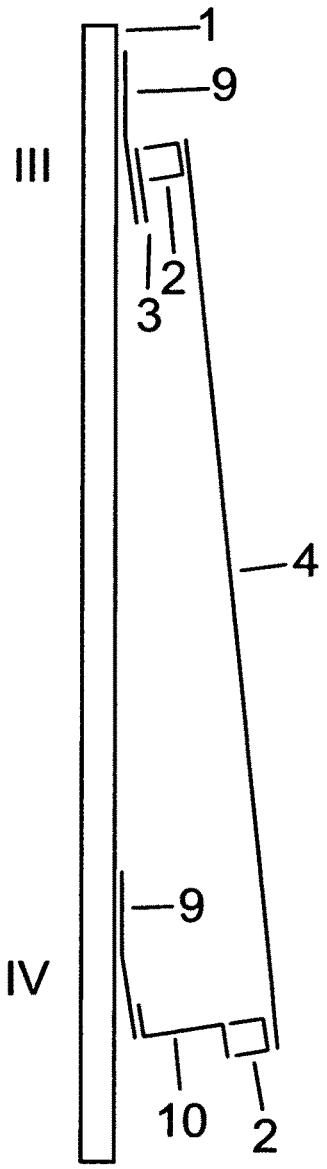
FIG. 9A This drawing is a side view of the backboard installed in a sloped position.
Figure 10A:
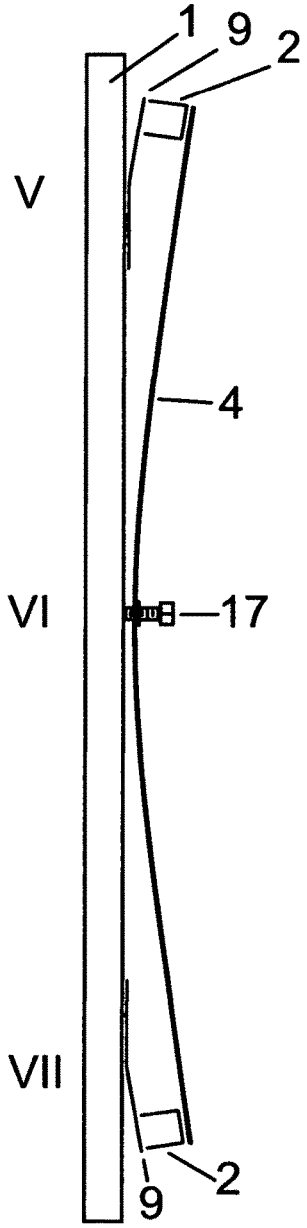
FIG. 10A This drawing is a side view of the backboard installed in a curved position.
Figure 11:
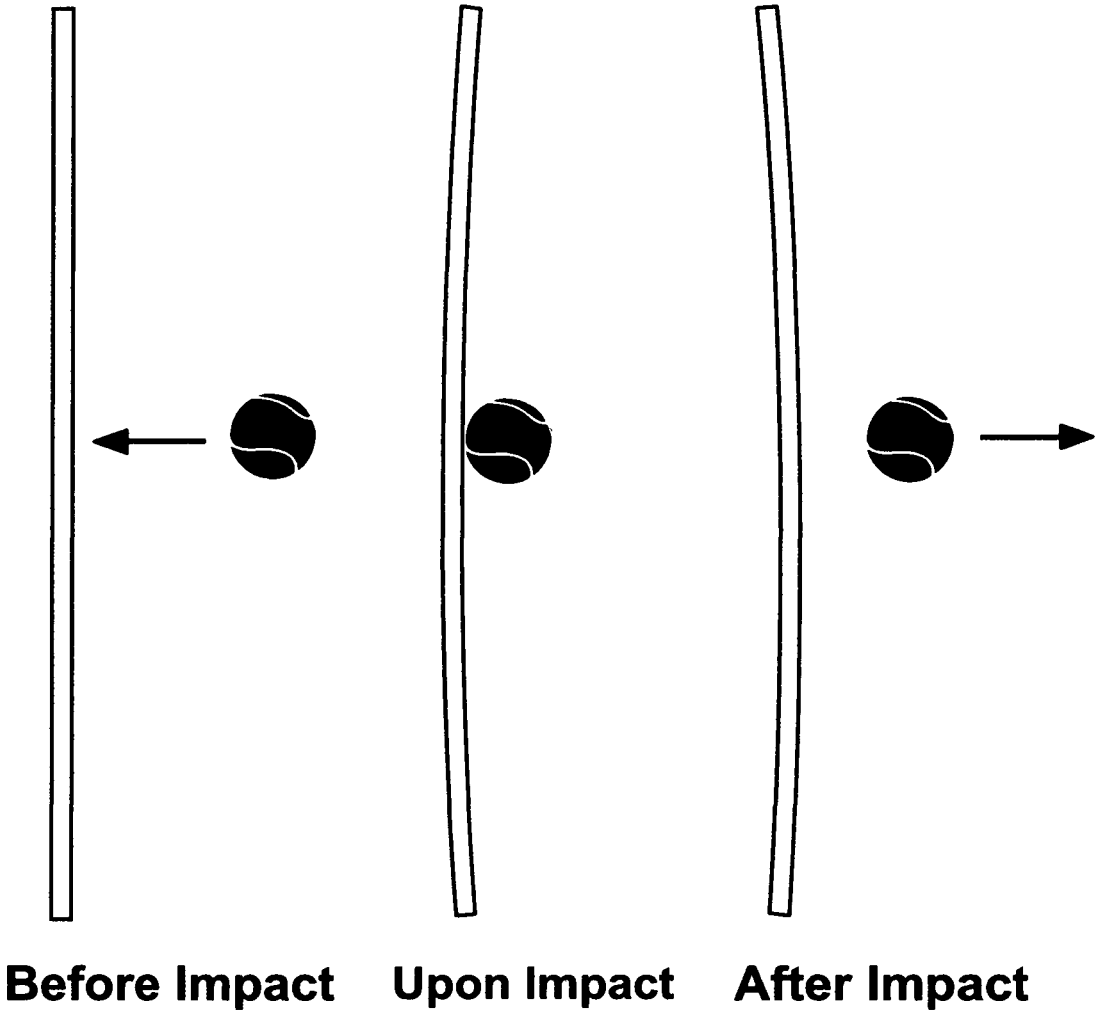
FIG. 11 This drawing shows the panel of the backboard flexing upon impact when struck by a tennis ball.

The backboard design incorporates Flex Technology. Flex technology has to do with the stiffness of a material, that is, its ability to flex. When a tennis ball strikes the backboard, the panel of the backboard flexes, absorbing some of the energy of the ball, and then releasing that energy back into the ball as it sends the ball back in the opposite direction of the ball before impact. This is illustrated in FIG. 11 of the drawings. This same sequence of impact and flex occurs when a tennis ball is struck with a tennis racket. As shown in FIGS. 8A, 9A, and 10A, the backboard (4) is attached at the top and bottom to the horizontal frame members (2). This allows the board to flex between the two horizontal frame members when struck by a tennis ball. The tennis ball is flung back to the hitter in a manner similar to the rebound from the strings of a tennis racket when hit by an opponent. Angular fittings are used to adjust the slope and curvature of the board. This invention is designed so that the backboard can be easily attached to a chain link fence, a concrete wall, a brick wall, a stud wall, or a portable platform. FIGS. 3A and 3B show the backboard attached to a chain-link fence. To mount the backboard to an existing chain-link fence, the two vertical strut channel members (1) of this invention are attached to the horizontal members of the framework structure of the chain-link fence. This is done by using ⅜ inch U-bolts to attach the slotted channel strut members (1) to the existing support framework of the chain-link fence. No cutting or drilling is required. Next, the Tee plate fittings (3) are attached to the vertical strut frame members (1) with bolt and channel nut (6), followed by fastening the horizontal frame members (2) to the Tee plates (3) with bolt and channel nut (8), and then the board (4) is attached to the horizontal frame members (2) using a number of bolts, nuts, and washers. The number of fasteners used depends on the size of the board being installed. The spacing for these fasteners matches the spacing of the slots on the strut channel.

Figure 4A:
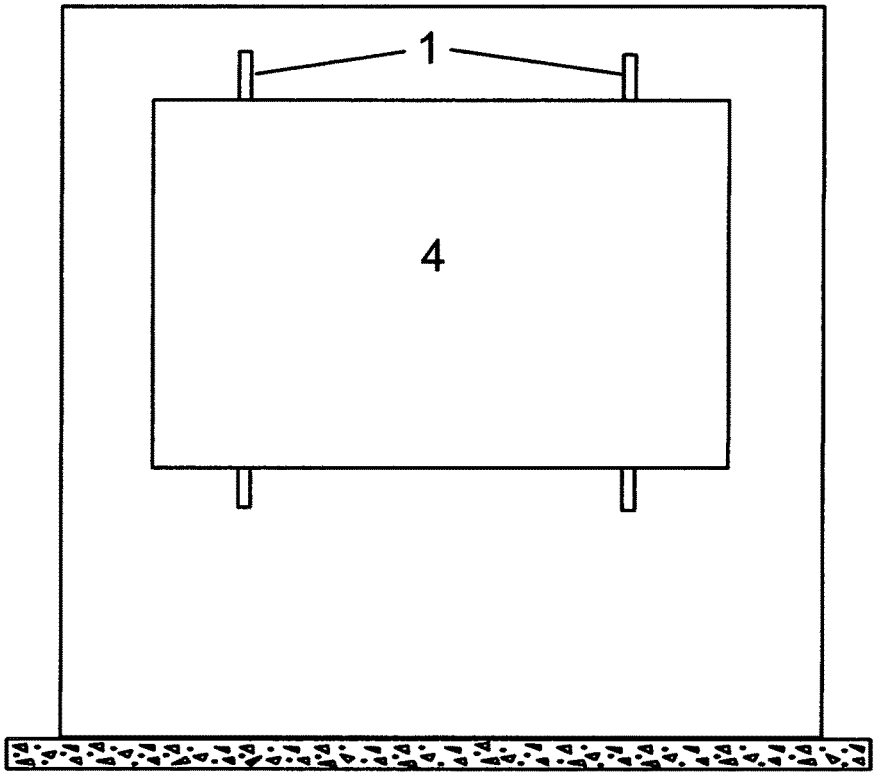
FIG. 4A This drawing shows the backboard installed on a concrete wall.
Figure 4B:
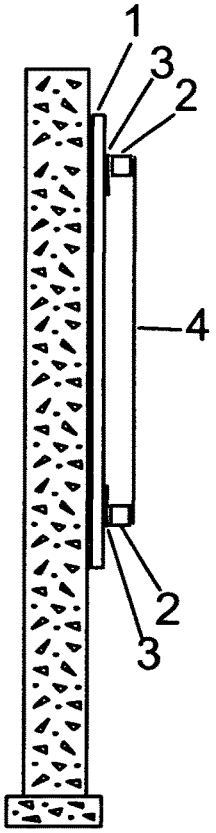
FIG. 4B This drawing is a side view of the backboard installed on a concrete wall.

FIGS. 4A and 4B show the backboard attached to a concrete wall. To mount the backboard to an existing concrete wall, the two vertical strut channel members (10) of this invention are attached to the wall with concrete anchors. The pre-punched slotted strut channel member is placed on the wall to mark the location for the holes to be drilled into the wall for the anchors. Once the concrete anchors are in place, the vertical strut members (1) are bolted to the wall. After the vertical strut members are fastened to the concrete wall, the procedure for mounting the backboard to the frame is the same as explained previously for mounting the backboard to a chain-link fence.

Figure 5A:
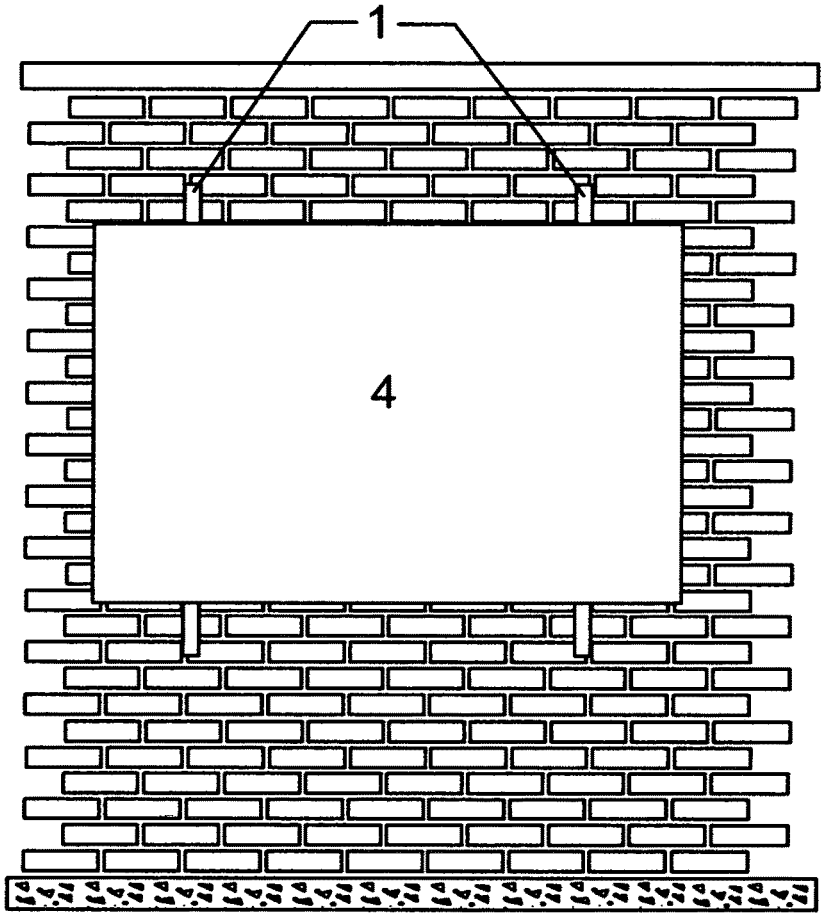
FIG. 5A This drawing shows the backboard installed on a brick wall.
Figure 5B:
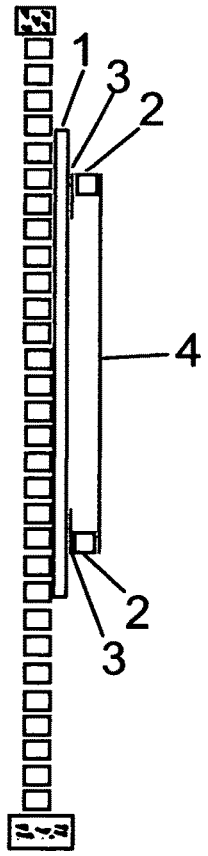
FIG. 5B This drawing is a side view of the backboard installed on a brick wall.

FIGS. 5A and 5B show the backboard attached to a brick wall. To mount the backboard to an existing brick wall, the two vertical channel strut members (1) of this invention are attached to the wall with concrete anchors. The pre-punched slotted strut channel member is placed on the wall to mark the location for the holes to be drilled into the wall for the anchors. Once the concrete anchors are in place, the two vertical strut 6 members (1) are bolted to the brick wall. After the vertical strut members are fastened to the brick wall, the procedure for mounting the backboard to the frame is the same as explained previously for mounting the backboard to a chain-link fence.

Figure 6A:
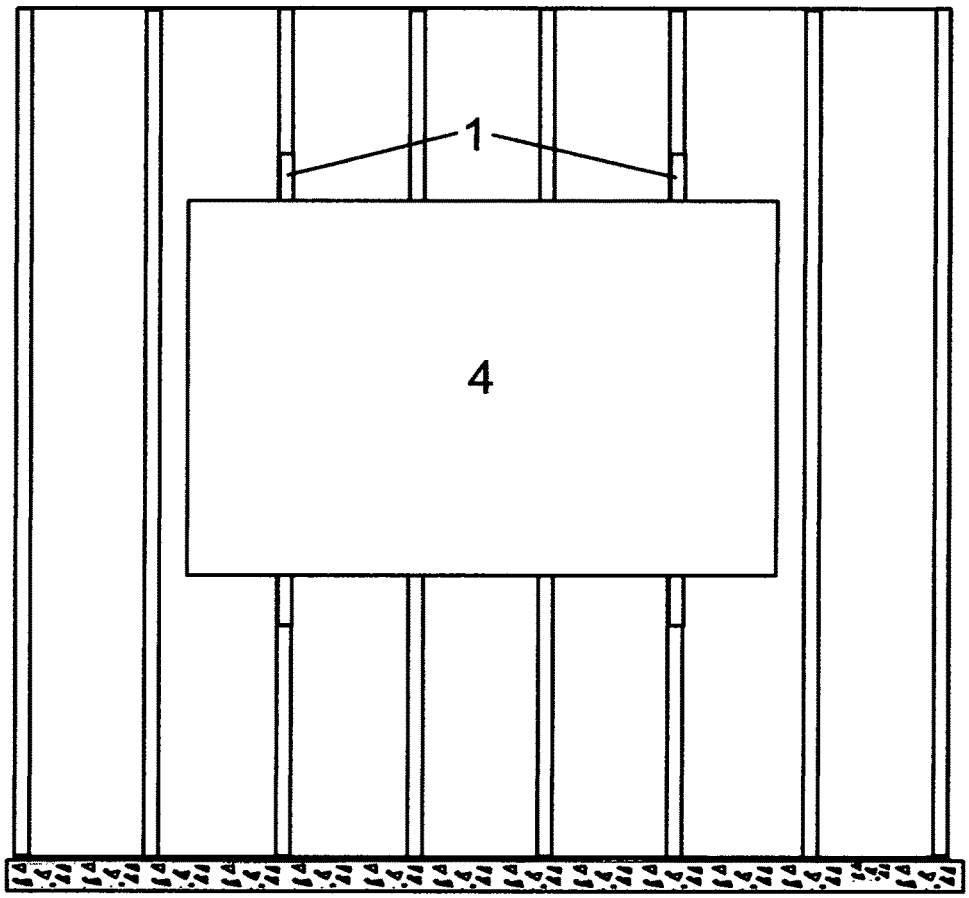
FIG. 6A This drawing shows the backboard installed on a stud wall.
Figure 6B:
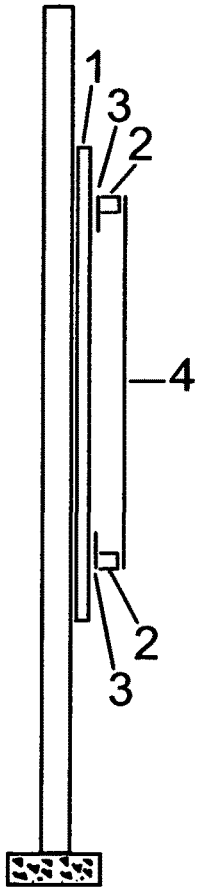
FIG. 6B This drawing is a side view of the backboard installed on a stud wall.

FIGS. 6A and 6B show the backboard attached to a stud wall. To mount the backboard to an existing stud wall in a garage, the two vertical strut channel members (1) of this invention are attached to the existing wall studs. These studs are usually wood and are spaced 16 inches on center. The pre-punched slotted strut channel member is placed on the wall to mark the location for the holes to be drilled into the wood stud for the lag bolts. The two vertical strut members (1) are attached to the stud walls using ⅜ inch lag bolts. The spacing for the vertical strut channel members and the lag bolts depends on the width of the backboard being installed and the alignment with the wall studs. After the vertical strut members (1) are fastened to the stud wall, the procedure for mounting the backboard to the frame is the same as explained previously for mounting the backboard to a chain-link fence.

Figure 7A:
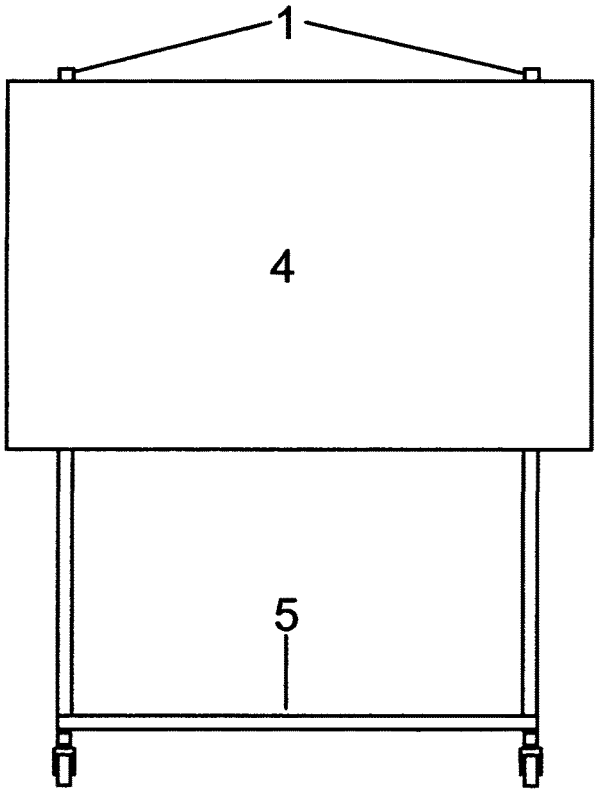
FIG. 7A This drawing shows the backboard installed on a portable platform.
Figure 7B:
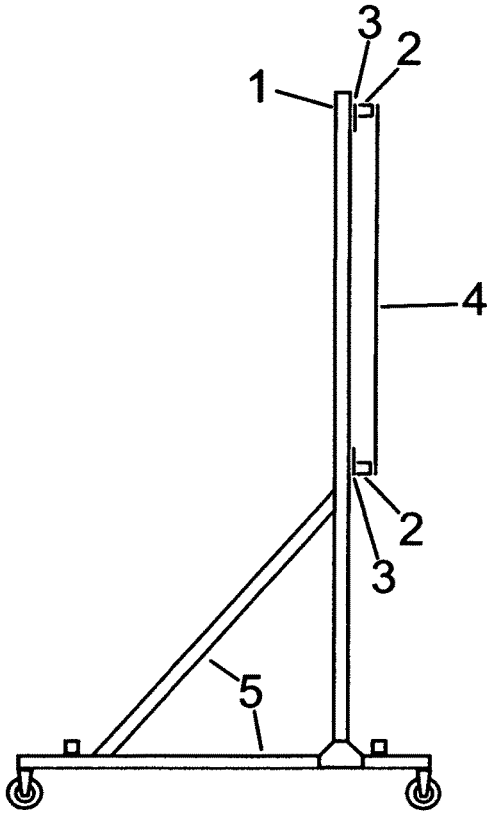
FIG. 7B This drawing is a side view of the backboard installed on a portable platform.

FIGS. 7A and 7B show the backboard attached to a portable platform. To mount the backboard to a portable platform, the two vertical strut channel members (1) of this invention are attached to a platform (5), such as the one shown in FIGS. 7A and 7B. In this illustration, the platform is constructed using strut channel and four castor wheels. The vertical strut members (1) are attached to the platform base (5). After the vertical strut members are fastened to the platform, the procedure for mounting the backboard to the frame is the same as explained previously for mounting the backboard to a chain-link fence. This invention incorporates a frame design that allows the same backboard to be mounted in a vertical position, a sloped position, or a curved position. Furthermore, the degree of slope of the backboard can be changed, as well as the degree of curvature of the backboard. This versatility allows the player to make adjustments to the backboard for a variety of hitting situations.

Figure 8B:
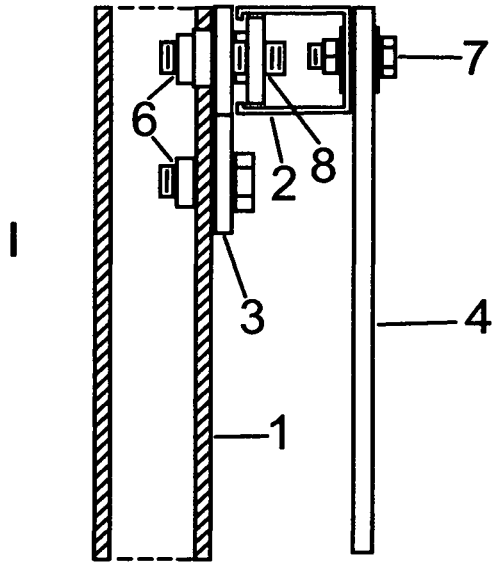
FIG. 8B This drawing is an enlarged view of section I shown in FIG. 8A.
Figure 8C:
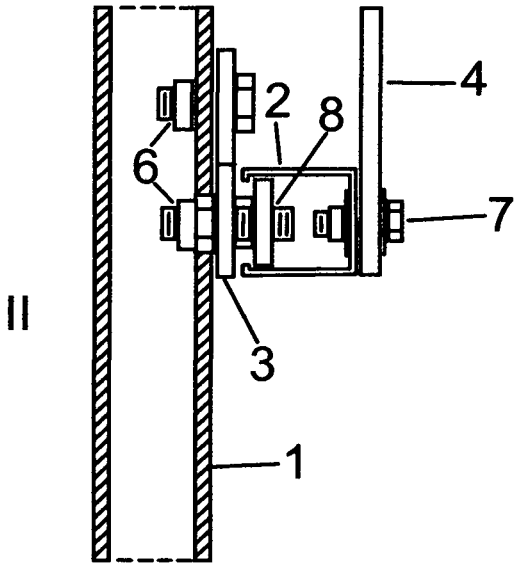
FIG. 8C This drawing is an enlarged view of section II shown in FIG. 8A.

FIG. 8A of the drawings shows the backboard mounted in a vertical position. The four Tee plates (3) are fastened to the two vertical strut members (1). The Tee plates can slide up and down the strut channel to any desired position along the channel and then locked into place using a bolt and channel nut. For a 4 foot by 6 foot backboard, the lower plate would typically be placed at a height of 36 inches, the height of a tennis net at the 7 center point, but could also be easily positioned at any point along the channel. The upper Tee plate (3) would be placed at a position of 4 feet above the lower plate. The two horizontal strut channels (2) are fastened to the Tee plates (3) using bolts and channel nuts. The backboard (4) is fastened to the horizontal strut channels (2) using a plurality of bolts, washers, and nuts (7) along the top and bottom sides of the board. The number of bolts used depends on the size of the board, but typically spaced approximately four inches apart to match the spacing of the pre-punched slots of the strut channels. The details for the assembly are shown in FIGS. 8B and 8C.

Figure 9B:
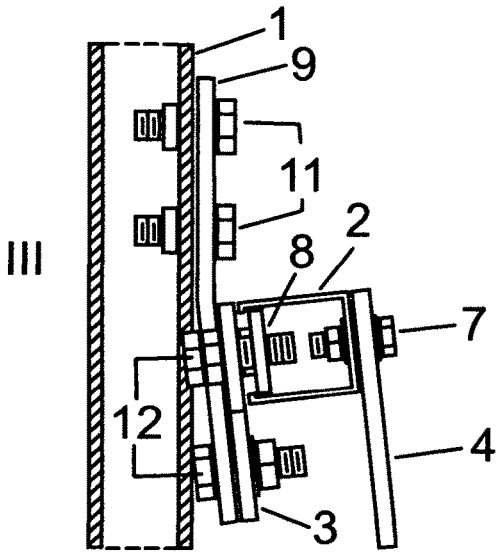
FIG. 9B This drawing is an enlarged view of section III shown in FIG. 9A.
Figure 9C:
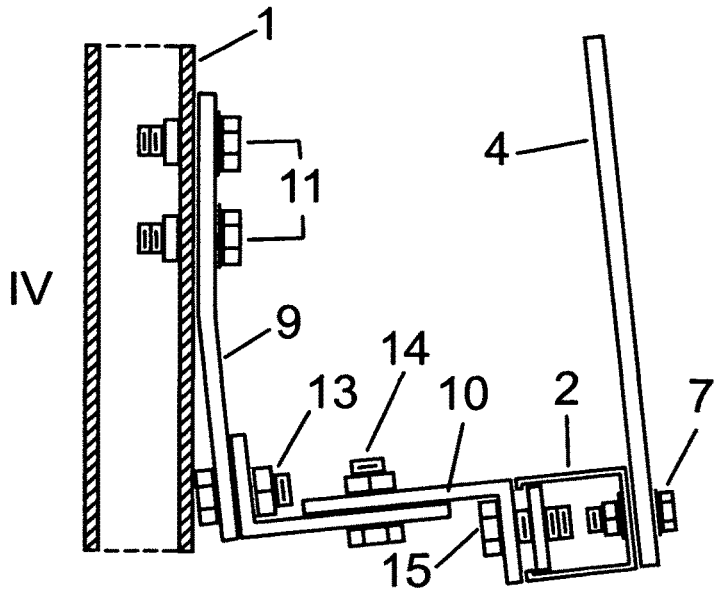
FIG. 9C This drawing is an enlarged view of section IV shown in FIG. 9A.

FIG. 9A of the drawings shows the backboard mounted in a sloped position. To mount the backboard of this invention in a sloped position, angular fittings (9) are used. An angular fitting with a 7.5 degree angle is preferred, but angular fittings with other angles can also be used. For most situations, a slope between six degrees and fifteen degrees is recommended. The angular fittings (9) are fastened to the vertical strut channels (1) using bolts and channel nuts (11). The bottom angular fitting is positioned along the strut channel so that the bottom of the backboard, when mounted, is approximately 36 inches above the ground level. A Tee plate fitting (3) is attached to the top angular fitting (9) with bolts (12). A "Z" fitting (10) is attached with a bolt (13) to the lower angular fitting (9) to adjust the distance between the lower angular fitting and the bottom of the backboard (4). The angle of slope is achieved by using different angular fittings (9) and by varying the length of the "Z" fitting (10) with a bolt (14). The top horizontal strut member (2) is fastened to the Tee fitting (3) and the bottom horizontal strut member (2) is fastened to the "Z" fitting (10) with a bolt (15). The board (4) is fastened to the horizontal frame members as explained previously for the vertical position. The details for the assembly are shown in FIGS. 9B and 9C.

FIG. 10A of the drawings shows the backboard mounted in a curved position. To mount the backboard of this invention in a curved position, angular fittings are used. An angular fitting with a 7.5 degree angle is preferred, but angular fittings with other angles can also be used. The lower fitting (9) is positioned on the vertical strut channel (1) so that the bottom horizontal strut channel (2) is at a height of 36 inches above the ground.

Figure 10B:
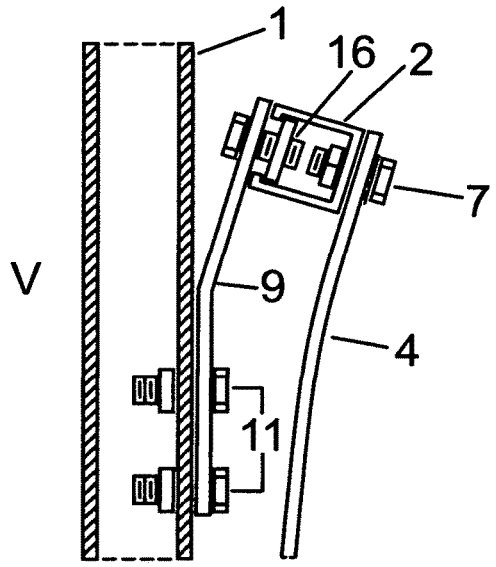
FIG. 10B This drawing is an enlarged view of section V shown in FIG. 10A.
Figure 10C:
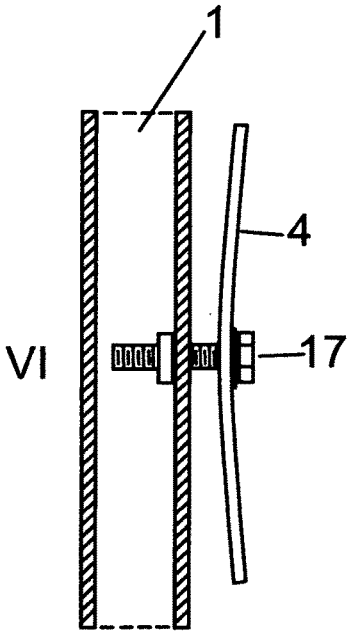
FIG. 10C This drawing is an enlarged view of section VI shown in FIG. 10A.
Figure 10D:
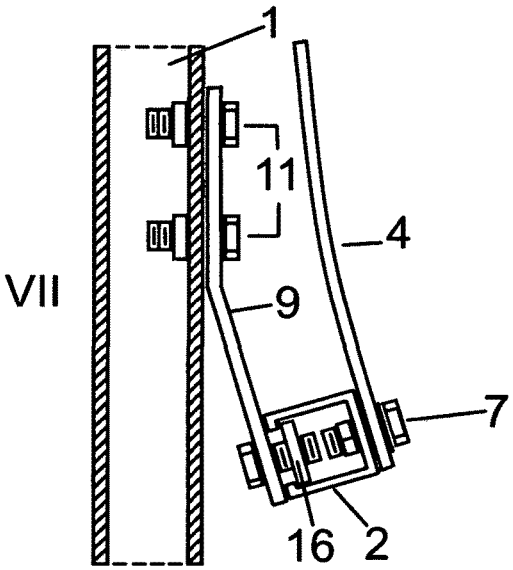
FIG. 10D This drawing is an enlarged view of section VII shown in FIG. 10A.

The bottom strut member (2) is fastened to the angular fitting (9) with a bolt (16). The upper angular plate (9) is positioned, temporarily, at approximately 48 inches above the lower fitting for a four foot high board. Two ⅜ inch bolts, washers, and channel nuts (17) are 8 used; one at the left side of the board and one at the right side of the board with both bolts located at the vertical center of the board. The two bolts (17) are in alignment with the vertical strut members (1). The bolts holding the top angular fittings (9) to the vertical strut member (1) are loosened to allow the top assembly to slide along the strut channel as the bolts (17) are tightened or loosened. The bolts (17) are tightened to pull the board in, creating a concave curve in the board (4). Once the desired curvature is obtained, the top angular fittings (9) are moved to be in alignment with the top horizontal strut member (2). Once in place, the bolts (11) are tightened, locking the upper angular fitting (9) into place. Once the upper horizontal frame member is in position, and the angular fittings locked into place, the two ⅜ inch bolts (17) can be removed, allowing the board to flex properly. It is noted that the curvature of the hitting surface can easily be changed by tightening or loosening the ⅜ inch bolts. The details for the assembly are shown in FIGS. 10B, 10C and 10D.

The invention claimed is:

1. An adjustable backboard for practicing tennis or other racket sports comprising:

a single panel comprising a flexible material allowing the panel to be given a curvature and can flex when struck with a ball whether mounted in a straight or a curved position;

a frame comprising an upper and a lower horizontal strut channel member to which said single panel is mounted at the top and bottom thereof, respectively, and two vertical strut channel members configured to be mounted to a substantially vertical surface or structure;

said horizontal and vertical strut channel members are adjustably fastened to one another using a plurality of tee plates and channel nuts such that strut channel members can slide relative to one another into a desired spacing;

said single panel is mounted to said upper and lower horizontal strut channel members at the top and bottom thereof, respectively, using top and bottom angular fittings to define top and bottom assemblies;

and two removable bolts configured to be in alignment with said vertical strut channel members;

wherein a curvature of the single panel within the frame is configured to be adjusted by tightening or loosening the two removable bolts which allows the top and/or bottom assemblies to slide along the vertical strut channels to create a desired curvature in the board; once the desired curvature is obtained, the top and bottom assemblies are fixed into place within the vertical strut channels and said removable bolts are removed, allowing the panel to flex during use.

* * * * *